US005172750A

United States Patent [19]

Birat et al.

[11] Patent Number: 5,172,750

[45] Date of Patent: Dec. 22, 1992

[54] INSTALLATION FOR CONTINUOUS CASTING BETWEEN ROLLS

[75] Inventors: Jean-Pierre Birat, Semecourt; Philippe Blin, Plappeville; Christophe Ganser, Fameck; Yves Grandgenevre, Rombas; Jean-Luc Jacquot, Metz; Jacques Spiquel, Montigny; Laurent Sosin, Fameck; Jean-Bernard Veyret, Metz, all of France

[73] Assignees: Usinor Sacilor, Puteaux, France; Thyssen Stahl Aktien-Gesellschaft, Duisburg; Thyssen Edelstahlwerke AG, Krefeld, both of Fed. Rep. of Germany

[21] Appl. No.: 748,927

[22] Filed: Aug. 23, 1991

[30] Foreign Application Priority Data

Sep. 3, 1990 [FR] France ..... 90 11000

[51] Int. Cl.[5] ..... B22D 11/06

[52] U.S. Cl. ..... 164/428; 164/480

[58] Field of Search ..... 164/428, 480

[56] References Cited

U.S. PATENT DOCUMENTS 5,058,658 10/1991 Veyret ..... 164/480

FOREIGN PATENT DOCUMENTS 348227 12/1989 European Pat. Off. .

360635 3/1990 European Pat. Off. .

OTHER PUBLICATIONS

Patent Abstracts of Japan, vol. 13, No. 425, Sep. 21, 1989, 1-162545.

Patent Abstracts of Japan, vol. 12, No. 229, Jun. 29, 1988, 63-026244.

*Primary Examiner*—Kuang Y. Lin

*Attorney, Agent, or Firm*—Cushman, Darby & Cushman

[57] ABSTRACT

Installation for continuous casting between two rolls (1,2) having parallel axes and defining therebetween and with two fixed lateral walls (3) a casting space for a liquid metal, each lateral wall comprising at least one lateral part (6) placed against the planar end face of an adjacent one of the rolls and constituted by a portion of a disc having an outside diameter equal to that of the adjacent roll, and a part (12) which is central relative to and confronts the casting space and is composed of an insulating refractory material. The disc portion is made from a material having properties of thermal conductivity and mechanical resistance superior to those of the refractory material and is a frustoconical disc portion whose face having the larger radius of curvature is placed against the adjacent roll and the disc portion defines a frustoconical surface which is in contact with the insulating material of the central part. The invention is applicable to the continuous casting of thin metallic products, in particular of steel.

16 Claims, 3 Drawing Sheets

Fig. 1.
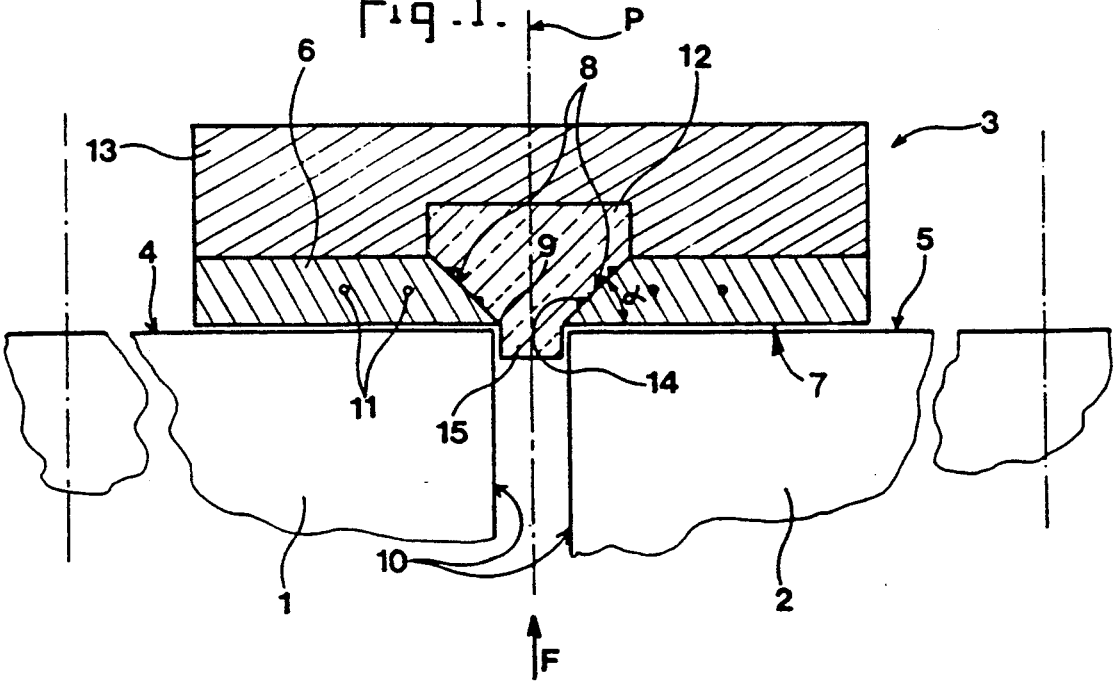
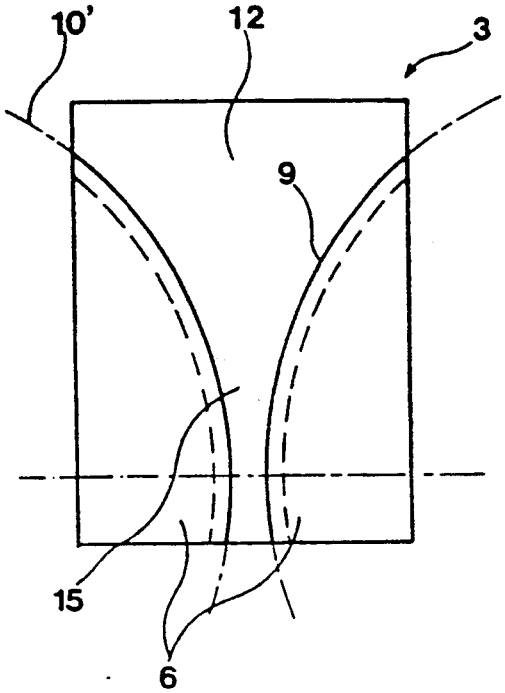
Fig. 2.
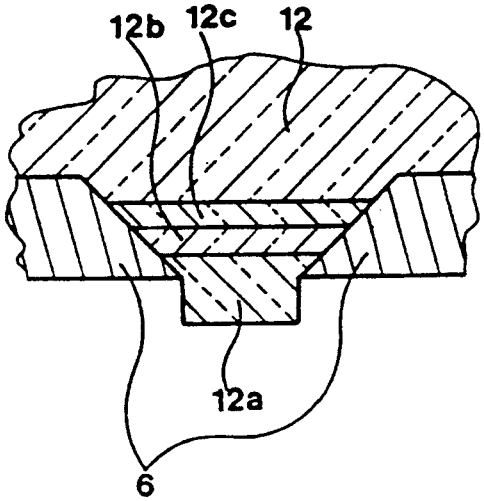
Fig. 11.

Fig. 3a
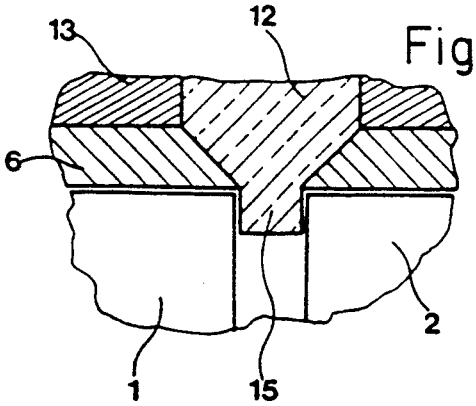
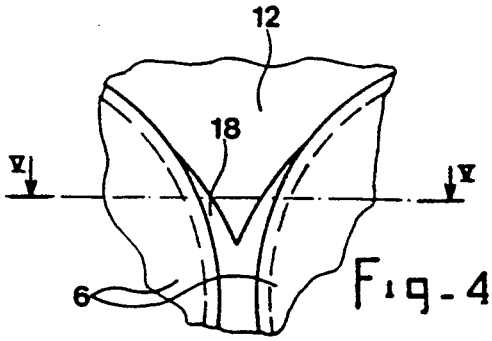
Fig. 4.
Fig. 3b
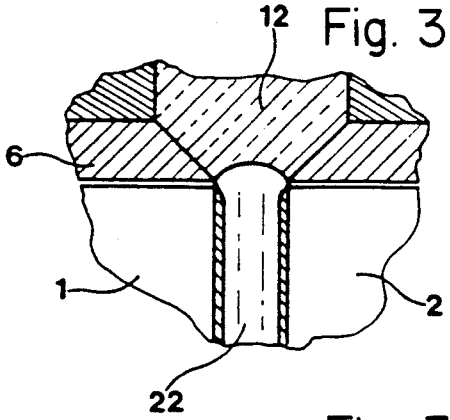
Fig. 5.
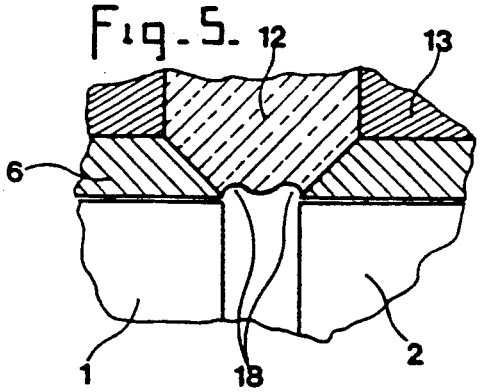
Fig. 3c
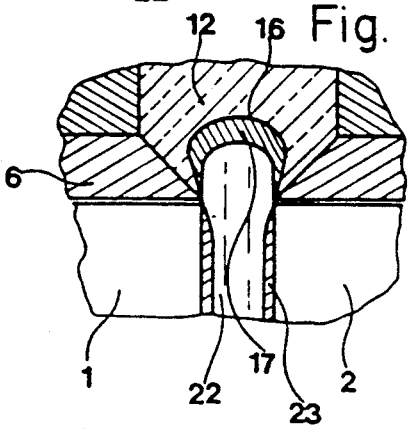
Fig. 7a
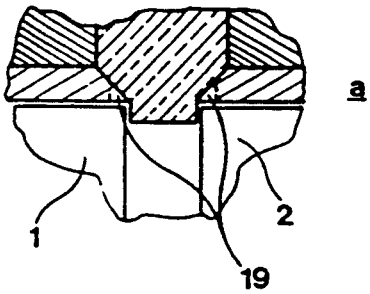
Fig. 6.
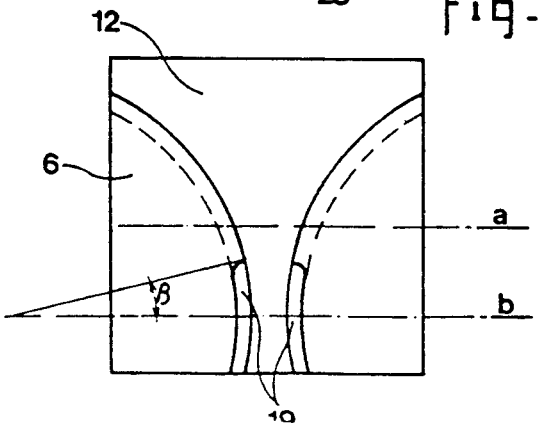
Fig. 7b
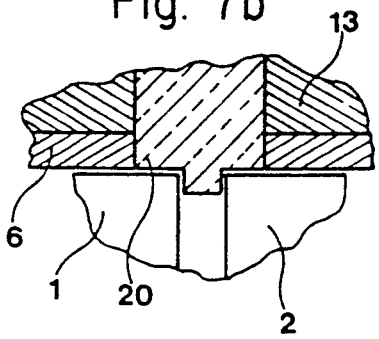

INSTALLATION FOR CONTINUOUS CASTING BETWEEN ROLLS

The present invention relates to the continuous casting of metals, in particular steel, between two rolls having parallel axes and driven in rotation in opposite directions, to obtain thin products.

It is known that in this type of casting, one of the problems is the confinement, adjacent to the ends of the rolls, of the liquid metal supplied to the casting space defined between the rolls. One solution to this problem is to employ fixed lateral walls maintained in a sealed manner against the rolls, and in particular against the confronting end faces of the latter. In order to avoid the solidification or freezing of the molten metal in contact with these walls and the formation of a solidified metal wedge which would prevent the correct formation of the edges of the cast product, it is already known to employ for these lateral walls a sufficiently insulating material which avoids or at least limits this solidification. However, such an insulating refractory material generally has insufficient mechanical properties to be maintained in contact with the moving rolls without resulting in a rapid wear of this material.

In order to solve this problem, it has already been proposed in the patent application published under No. FR 2636259 to provide lateral walls only a central region of which is formed by an insulating material. Two metal strip portions placed on each side of this material slightly penetrate between the rolls and conform to the curvature of the latter. Apart from an improved strength, these strip portions aid the seal between the rolls and the lateral walls owing to the fact that the solidified metal skins extend along these fixed strip portions on which the edges of the skins slide and thereby cover the joint between the rolls and the lateral walls.

A lateral wall has also been proposed in the French patent No. 89 08086 in the name of the present applicant, which comprises at least one lateral part, for example of metal, which faces the planar end face of a roll, and whose surface confronting the casting space is in the extension of the face of said roll and is connected to a front face part of said wall, set back in the latter from the lateral part so as to form in the wall a hollow region which laterally extends the casting space.

An object of the present invention is to provide another solution to the aforementioned problem.

The invention therefore provides for this purpose an installation for the continuous casting between two rolls having parallel axes defining therebetween and with two fixed lateral walls a casting space for a molten metal, each lateral wall comprising at least one lateral part placed against the planar end face of an adjacent one of the rolls and constituted by a portion of a disc whose outside diameter is equal to the diameter of said adjacent roll, and a part which is central relative to and confronts said casting space and composed of an insulating refractory material, said installation being characterized in that said disc portion is composed of a material having good properties of thermal conductivity and mechanical resistance superior to those of said refractory material, and is a frustoconical disc portion whose face having the larger radius of curvature is located adjacent to the roll, and whose frustoconical surface is in contact with the insulating material of said central part.

As the disc portion confronting the end face of the roll has a resistance to friction, it may be placed against the roll with sufficient force to ensure the seal with no risk of deterioration or wear. The central part of insulating material avoids an excessive solidification of the metal and the formation of the wedge referred to hereinbefore. In the course of the casting, this central part may be worn by the metal which creates a hollow but in doing so the metal which enters the hollow formed in this way moves closer to the frustoconical surface of the disc portion which is maintained at a low temperature owing to the fact, among other reasons, of its thermal conductivity and its closeness to the cooled surfaces of the rolls. Consequently, the surface of this metal solidifies and the solidified part in this way clings to the insulating refractory material and forms a kind of slideway in which the liquid metal can flow to the region of the neck between the rolls where it forms, when solidified, the edge of the product.

As will be better understood hereinafter, the arrangement of the lateral wall according to the invention permits forming at the beginning of the casting an "autocrucible" constituted by the skin of solidified metal in the insulating refractory material which is stabilized owing to the proximity of the disc portions and thereby stops the progression of the wear of said refractory material and permits pursuing the casting. Owing to the conical surface of the disc portions, the horizontal section of this autocrucible in proximity to the neck between the rolls takes on a C-shape whose branches have a thickness which decreases toward their ends so that the distance between these branches is substantially constant, which permits obtaining edges of the cast product whose thickness is substantially equal to the thickness of the central region of the product.

According to a particular arrangement, the frustoconical surface of the disc portion may include asperities, such as points, which improve the clinging properties of the insulating material and consequently the maintenance of the autocrucible on its edges.

According to another arrangement, the central part of insulating refractory material may be formed by a plurality of materials arranged in successive layers and having properties of mechanical resistance and/or thermal insulation which gradually differ from the material located adjacent to the casting space which has the highest coefficient of insulation.

The disc portions, or at least the region corresponding to the larger disc diameter, may be coated with or formed by a heat resistant material having in particular a good mechanical performance at high temperature, such as zirconia, and moreover may be cooled for example by an internal circulation of a cooling fluid.

Further features and advantages of the invention will be apparent from the following description given by way of example of an installation for the continuous casting of thin steel products according to the invention.

With reference to the accompanying drawings:

FIG. 1 is a partial representation of an installation for continuous casting between two rolls, in the form of a top plan view and a section taken on a horizontal plane;

FIG. 2 is a side elevational view, to a reduced scale, of the closing wall in the direction of arrow F shown in FIG. 1;

Figure 8:
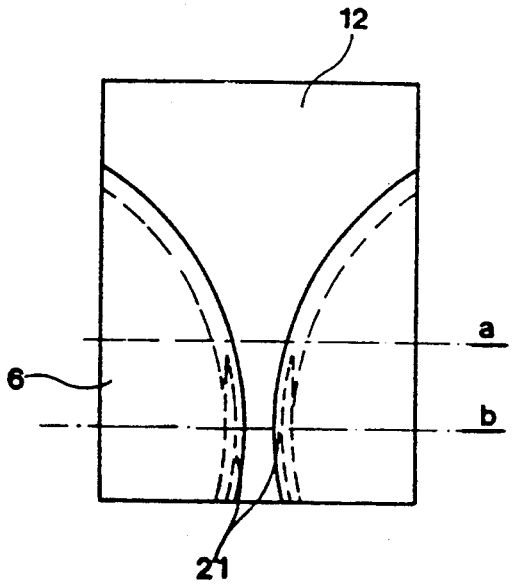
Figure 9A:
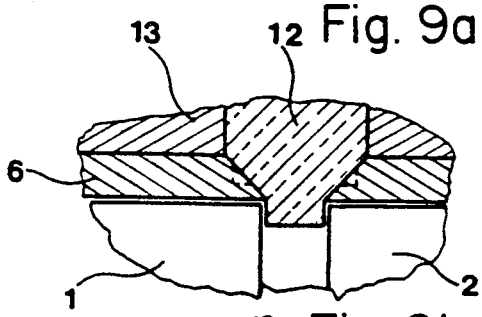
Figure 9B:
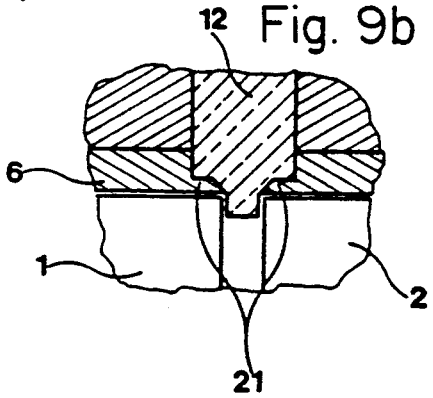
Figure 10:
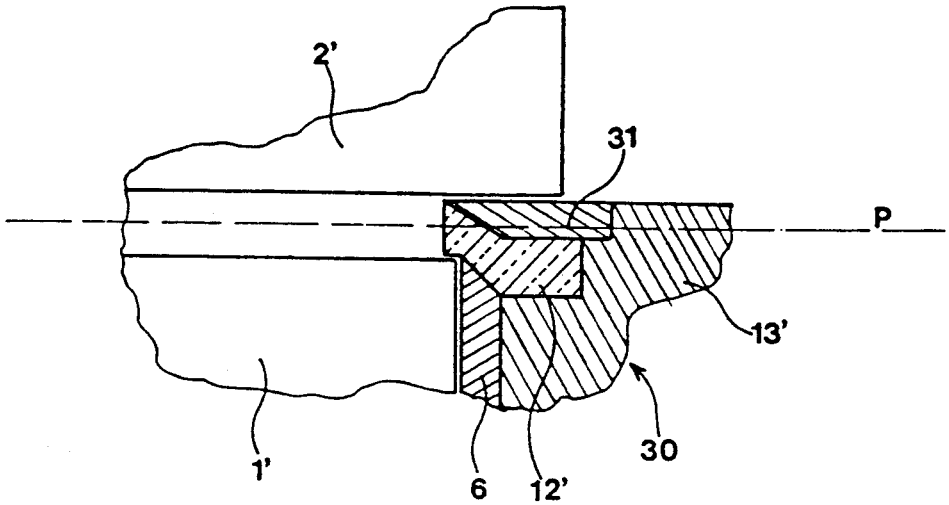

FIGS. 3*a* to 3*c* are diagrams showing the evolution, at the beginning of the casting operation, of the central part of the lateral wall in proximity to the neck between the rolls;

FIG. 4 is a diagrammatic side elevational view of the lateral wall in established casting conditions;

FIG. 5 is a sectional view, taken on line V—V of FIG. 4, of the wall in established casting conditions;

FIG. 6 is a side elevational view of the lateral wall according to a first variant;

FIGS. 7*a* and 7*b* are sectional views of the wall shown in FIG. 6 at the levels shown respectively at a and b in this Figure;

FIG. 8 is a side elevational view of the lateral wall in a second variant;

FIGS. 9*a* and 9*b* are sectional views of the wall shown in FIG. 8 at the levels shown respectively at a and b in this Figure;

FIG. 10 is a partial sectional view of another variant in the case of an installation for casting between rolls which are axially movable relative to each other;

FIG. 11 is a detail view, to an enlarged scale, of the central region of the wall in the case of an insulating material in several layers.

The installation for continuous casting between rolls partly shown in FIG. 1, comprises two rolls 1 and 2 having parallel and horizontal axes and driven in rotation, and two lateral walls for closing the casting space, such as the wall 3, located adjacent to the ends of the rolls and maintained against the end faces 4, 5 of the latter.

The lateral wall 3, shown in FIG. 1 in section in a horizontal plane at the level of the axes of the rolls and in side elevation in FIG. 2, comprises two lateral parts 6 each constituted by a portion of a frustoconical disc whose larger outside diameter is equal to that of the rolls, so that the face 7 of these disc portions having the larger radius of curvature is located against the end face 4, 5 of the adjacent roll, and the edge 9 of the bevel formed by the frustoconical surface 8 and the face 7 of these disc portions faces the edge formed by the lateral edge portion of the cylindrical surface 10 of the corresponding roll.

In FIG. 2, the rolls are shown solely by the trace 10' of their cylindrical surface, and it can be seen that this trace coincides with the edge 9 of the disc portions. The angle of the bevel, i.e. the angle $\alpha$ at the base of the frustoconical disc portion is 5° to 85° and preferably about 30°.

The disc portions constituting the lateral parts 6 of the closing wall 3 are made from a material which has good mechanical properties, is wear resistant and preferably has a low coefficient of friction so as to limit the forces created by a possible rubbing of the rolls on these disc portions. They may for example be made from iron, steel, or copper, and friction may be reduced by a lubrication.

Note that the mechanical resistance of the material of the disc portions also permits avoiding the deterioration of the latter if, as a result of wear of the insulating refractory, the cast metal, in process of solidification, comes into contact therewith. The progression of the wear is stopped, or at least greatly slowed down, and infiltrations of metal between these disc portions and the rolls are consequently avoided.

In the vicinity of the edge 9, the disc portions 6 may also be coated with, or constituted by, a material which has a mechanical resistance particularly high at high temperature, has preferably only a slight tendency to be wetted by the molten casting metal, and is inert in contact with liquid steel so as to avoid deterioration of the edges 9 of the disc portions, or the clinging of the cast metal to the latter in the event that the molten metal is brought into contact with these edges in the course of casting. For example, there may be employed a deposit of ceramic (for example zirconia) on a substrate which is of metal or also of ceramic, or the disc portion may be constructed in the form of a single element of ceramic or composite ceramic, or an antioxidant coating may be employed.

Further, these disc portions may be cooled, for example by a circulation of a cooling fluid in ducts 11 provided in the disc portions, it being necessary for the cooling achieved in this way to be sufficient to maintain the region in the vicinity of the edge at a temperature lower than that corresponding to a possible deterioration thereof, without however having a cooling effect on the cast metal.

Placed between the two disc portions 6, is a part 12 of the lateral wall 3 which is central relative to said casting space, composed of an insulating refractory material and in sealed contact with the frustoconical surfaces 8 of the disc portions 6. This central part of insulating refractory material is retained at the rear of the wall 3 by a support plate 13 on which the disc portions 6 are fixed.

In order to improve the anchoring of the insulating refractory material to the disc portions 6, and in particular in proximity to the neck between the rolls, the frustoconical surface of the disc portions is provided with asperities, such as points 14, which penetrate said insulating refractory material, or recesses, for example formed by drilling, into which said material extends.

Further, the central part 12 preferably comprises an extension 15 relative to the plane of the faces 7 of the disc portions which is inserted between the rolls. The insulating refractory material has a thermal conductivity lower than 0.35 W/m.K, i.e. it must be sufficiently insulating to avoid the solidification or freezing of the metal upon contact of the latter with this refractory material, and have a good dimensional stability during large variations in temperature. There may be employed for example a fibrous refractory, for example composed of alumina fibers impregnated with zirconia gel (for example of the type sold under the name Procelit or Procal).

In order to explain more clearly the advantages of the lateral wall according to the invention, the diagrams of FIG. 3 show the evolution of this wall at the beginning of the casting.

FIG. 3*a* shows to an enlarged scale the central region of the lateral wall before the beginning of the casting in a plane located slightly above the neck or gap between the rolls. Consequently, the wall and the extension 15 which slightly penetrates between the rolls can be seen.

After a relatively short period of casting, the cast metal 22 has worn away the insulating refractory material by eliminating the extension 15 and slightly hollowing out the central part, as shown in FIG. 3*b*.

As casting proceeds, the metal continues to hollow out the insulating refractory and creates in the latter a cavity 16 of rounded sectional shape. The solidified or frozen skin 17 which is then formed in this cavity clings to the insulating refractory material and forms the aforementioned autocrucible.

It will be observed that the autocrucible 17 occupies in the insulating refractory material a space which is larger than that existing at the same level between the rolls. This extra width is allowed by the particular design of the lateral walls according to the invention, and in particular by the fact that the disc portions 6 are frustoconical.

Further, this extra width of the autocrucible enables the edge portions of the cast product to conserve a thickness which is substantially equal to the general thickness of the product. It will indeed be understood that the edge portions of the final product are obtained from the metal in process of solidification which moves, simultaneously with the metal passing between the rolls, in the vertical trough formed by the autocrucible which is fixed relative to the lateral wall.

It will also be understood that, as soon as the autocrucible is formed, the latter protects the insulating refractory material from direct contact with the molten metal and prevents further wear thereof, which affords stability of the procedure as casting proceeds.

Note also that the metal skins 23, solidified upon contact with the rolls and moving with the latter, are not connected to the skin 17 forming the autocrucible.

FIGS. 4 and 5 show the lateral wall in established casting conditions, respectively in plan and in horizontal section at the level of the line V—V located distinctly above the neck. There is seen the V-shaped hollowing out resulting from wear of the insulating refractory material by the edges of the metal skins 23 solidified on the rolls. The depth and width of the worn parts 18 increase in the downward direction until they join up and form the cavity 16 shown in FIG. 3*c*, which is the seat of the autocrucible 17.

Note moreover that the formation and stability of the autocrucible result from the thermal equilibrium which is established between the cast metal and the different parts of the installation and in particular the lateral wall. This is why the insulating refractory material, contacted by the molten metal at the beginning of the casting operation, must have a highly insulating property to avoid a premature solidification of said metal between the edges of the rolls. Further, it is desirable that the autocrucible, when it is formed, be as stable as possible. For this purpose, the central part of the wall may be arranged in the form of a composite element shown in FIG. 11 comprising a plurality of layers 12*a*, 12*b*, 12*c* of different refractory materials disposed vertically, whose properties of mechanical resistance increase and whose properties of thermal insulation correlatively decrease in the direction from the plane of the faces 7 of the disc portions toward the support plate 13. Thus, right at the beginning of the casting, it is the thermal insulation aspect which is preponderant upon the first contact of the molten metal with the insulating refractory material, whereas, during formation of the autocrucible, the hollowing out of the central part causes the autocrucible to reach the layers which are mechanically more resistant, which limit the progression of the hollowing out and, when established casting conditions are reached, afford an improved seating for the autocrucible.

The last layer, or the support plate 13 itself, constitutes a safety plate precluding any risk of flow of molten metal in the event of a perforation of the autocrucible. It may be made for example from a hard material which does not deform by expansion, such as silica.

According to a variant shown in FIGS. 6 and 7, the disc portions comprise in their lower part, in the vicinity of the neck between the rolls, a recess 19. This recess 19 if formed in the beveled part of the disc portions down to the base of the lateral wall, from a corresponding widening of the insulating refractory material. This recess is consequently being filled by a corresponding widening of the insulating refractory material, 12, which is consequently in contact with the end of the rolls throughout the height of this recess. The presence of the insulating material, which is softer than the material constituting the disc portions, allows a spreading, outside the action of the rolls, of the edge portions of the product solidified in proximity to the neck between the rolls. The rolling force in the region of the neck and at the edges of the rolls may be reduced in this way, which avoids deterioration of said edges.

The height of this recess above the neck will be preferably about the length of an arc on the periphery of the rolls which subtends and angle $\beta$ of 2° at the centre of the roll (FIG. 6).

In another variant shown in FIGS. 8 and 9, the disc portions are recessed in the same region as above but only in a part of their thickness, thereby leaving a thinned-down part 21 of the disc in contact with the rolls, which avoids direct contact of the refractory material with the rolls while in large part conserving the possibility of the spreading of the edge portion of the cast product mentioned hereinbefore.

These recesses moreover allow the passage into the refractory material of a possible extra thickness of the edge of the product which could result from an excessive temporary widening of the autocrucible.

There is shown in FIG. 10, in section at the level of the neck between the rolls, an application of the invention to the case of casting between two axially offset rolls, for example in an installation allowing the casting of products of variable width achieved by a relative axial shifting of the rolls.

In this case, the lateral wall is not symmetrical, as in the preceding embodiments, relative to the median plane P of the installation parallel to the axes of the rolls. This wall 30 is constructed, on the side where it is in contact with the end face of the roll 1' (lower part of FIG. 10), in the same manner as in the embodiments described hereinbefore, and comprises a frustoconical disc portion 6' fixed to a support plate 13', and a part 12' which is central relative to the casting space and composed of an insulating refractory material. The other side of the wall 30 (the upper part of FIG. 10) is formed by a member 31 placed against the cylindrical surface of the roll 2' and for example composed of the same material as the disc portion 6', this strip being also beveled, shaped to conform to the curvature of the roll 2' and also fixed to the support plate 13'. The insulating refractory material fills the space between the disc portion 6' and the metal member 31.

This lateral wall is in fact equivalent to that of the variant adapted to the axially offset rolls of the wall described in the aforementioned French patent application No. 89 08086, to which reference may be made for further details and to which the principle of the wall according to the present invention has been applied.

It will be easily understood that the special arrangement shown in FIG. 10 permits the axial shifting of the roll 2' with respect to the roll 1' and to the wall 30 to vary the width of the cast product.

It will also be understood that, in the case of this variant, the autocrucible which is formed in a manner similar to that previously explained, will not be symmetrical relative to the plane P but offset toward the disc portion 6', which causes an edge portion of the thin product to be formed which is slightly bent relative to the general plane of the thin product obtained. This apparent defect is not however detrimental when the edge portions of the product are subsequently removed after casting, for example by shearing. On the contrary, in this case the removal of the edge portions may be facilitated.

The scope of the invention is not intended to be limited to the previously-described embodiments and variants and includes any arrangements resulting from the combination of said embodiments or variants.

What is claimed is:

1. Installation for continuous casting comprising two rolls having parallel axes of rotation, each roll having planar end faces at opposite ends of said each roll, two fixed lateral walls respectively located at said opposite ends of said rolls, said rolls defining between said rolls and with said two fixed lateral walls a casting space for molten metal, each of said lateral walls comprising at least one lateral part placed against said planar end face of an adjacent one of said rolls and constituted by a portion of a disc having an outside diameter equal to an outside diameter of said adjacent roll, and a part which is central relative to said casting space, confronts said casting space and is composed of an insulating refractory material, said disc portion constituting said at least one lateral part being made from a material having properties of thermal conductivity and mechanical resistance superior to properties of thermal conductivity and mechanical resistance of said refractory material and being a frustoconical disc portion having a face which has an edge having a first radius of curvature and is remote from said adjacent roll and a face which has an edge having a larger radius of curvature than said first radius of curvature and is placed against said end face of said adjacent roll, said frustoconical disc portion having a frustoconical surface which is in contact with said insulating material of said central part.

2. Installation according to claim 1, wherein said frustoconical surface makes an angle of between 5° and 85° with said face of said frustoconical disc portion which is placed against said adjacent roll.

3. Installation according to claim 1, wherein said insulating refractory material is fibrous alumina.

4. Installation according to claim 1, wherein said central part comprises a plurality of layers of materials which have properties of mechanical resistance which increases in a direction away from that one of said layers which confronts said casting space.

5. Installation according to claim 1, wherein said disc portion constituting said at least one lateral part is composed of a material selected from the group consisting of iron, steel, copper, molybdenum and alloys thereof.

6. Installation according to claim 1, wherein said disc portion constituting said at least one lateral part defines a frustoconical surface comprising asperities.

7. Installation according to claim 1, wherein said face of said disc portion constituting said at least one lateral part which is placed against said adjacent roll is coated with a material having a good mechanical performance at high temperature.

8. Installation according to claim 1, wherein said face of said disc portion constituting said at least one lateral part which is placed against said adjacent roll is constituted by a material having a good mechanical performance at high temperature.

9. Installation according to claim 7, wherein said material having a good mechanical performance is zirconia.

10. Installation according to claim 8, wherein said material having a good mechanical performance is zirconia.

11. Installation according to claim 1, wherein said disc portion constituting said at least one lateral part is cooled.

12. Installation according to claim 1, wherein said casting space includes a neck between said rolls in a plane containing said axes of rotation, and said disc portion constituting said at least one lateral part defines a recess in a zone thereof in the vicinity of said neck, said recess being filled with an insulating refractory material.

13. Installation according to claim 12, wherein said recess is made throughout the thickness of said disc portion constituting said at least one lateral part.

14. Installation according to claim 12, wherein said recess is made in a part of the thickness of said disc portion constituting said at least one lateral part thereby leaving a thinned-down portion of said disc portion constituting said at least one lateral part, said thinned-down portion being in contact with said adjacent roll.

15. Installation according to claim 1, wherein said central part comprises an extension penetrating said casting space between said rolls.

16. Installation for continuous casting comprising two rolls having parallel axes of rotation, each roll having planar end faces at opposite ends of said each roll, two fixed lateral walls respectively located at said opposite ends of said rolls, said rolls defining between said rolls and with said two fixed lateral walls a casting space for molten metal, each of said lateral walls comprising two lateral parts each placed against said planar end face of a respective one of said rolls and a central part which is disposed between said lateral parts, confronts said casting space and is composed of an insulating refractory material, each lateral part being constituted by a portion of a disc having an outside diameter equal to an outside diameter of said respective roll, said disc portion being made from a material having properties of thermal conductivity and mechanical resistance superior to properties of thermal conductivity and mechanical resistance of said refractory material and being a frustoconical disc portion having a face which has an edge having a first radius of curvature and is remote from said respective roll and a face which has an edge having a larger radius of curvature than said first radius of curvature and is placed against said end face of said respective roll, each frustoconical disc portion having a frustoconical surface which is in contact with said insulating material of said central part.

* * * * *